US011708972B2

(12) United States Patent
Munsterhuis et al.

(10) Patent No.: US 11,708,972 B2
(45) Date of Patent: Jul. 25, 2023

(54) GAS/AIR MIXING DEVICE OF A GAS BURNER

(71) Applicant: Pittway Sarl, Rolle (CH)

(72) Inventors: Sybrandus B. V. Munsterhuis, Dalen (NL); Li Hong Rao, Tianjin (CN); Guan Jun Liu, Tianjin (CN)

(73) Assignee: Pittway Sarl, Rolle (CH)

( * ) Notice: Subject to any disclaimer, the term of this patent is extended or adjusted under 35 U.S.C. 154(b) by 234 days.

(21) Appl. No.: 17/323,607

(22) Filed: May 18, 2021

(65) Prior Publication Data

US 2021/0396384 A1 Dec. 23, 2021

(30) Foreign Application Priority Data

May 19, 2020 (EP) ..... 20175430
Apr. 20, 2021 (CN) ..... 202110423247.4

(51) Int. Cl.
*F23D 14/62* (2006.01)
*F23D 14/36* (2006.01)
*F23L 5/02* (2006.01)

(52) U.S. Cl.
CPC ..... *F23D 14/62* (2013.01); *F23D 14/36* (2013.01); *F23L 5/02* (2013.01); *F23D 2900/14642* (2013.01)

(58) Field of Classification Search
CPC ..... F23D 2900/14642; F23L 5/02
See application file for complete search history.

(56) References Cited

U.S. PATENT DOCUMENTS 6,106,276 A 8/2000 Sams et al.
9,677,761 B2 6/2017 Ranalli et al.
2018/0038592 A1* 2/2018 Willis ..... F23C 1/00
2022/0136269 A1* 5/2022 Roy ..... F24H 1/0027 4/493

FOREIGN PATENT DOCUMENTS

EP 1959194 A1 8/2008
EP 2426413 A2 3/2012
EP 2762780 A2 8/2014
EP 2927584 A1 10/2015
EP 3015768 A1 5/2016
EP 3415817 A1 12/2018

* cited by examiner

*Primary Examiner* — Lorne E Meade
(74) *Attorney, Agent, or Firm* — Greenberg Traurig, LLP; Ryan D. Sharp; David J. Dykeman

(57) ABSTRACT

In some examples, a gas/air mixing device configured to mix gas and air to provide a gas/air mixture includes a mixer housing with a mounting flange being configured to mount the gas/air mixing device to a fan housing in such a way that a sealing surface of the mounting flange is in contact with a sealing surface of the fan housing. In some examples, the sealing surface of the mounting flange has grooves with a second radius being different from the first radius. In some examples, the sealing surface of the fan housing has a groove, with a second radius being different from the first radius. The mixer housing provides an inlet opening for air, an inlet opening for gas, and an outlet opening for the gas/air mixture. The sealing surface of the mounting flange surrounds the outlet opening of the mixer housing.

18 Claims, 4 Drawing Sheets

GAS/AIR MIXING DEVICE OF A GAS BURNER

This application claims priority from European Patent Application No. 20175430.6, filed May 19, 2020, and Chinese Patent Application No. 202110423247.4, filed Apr. 20, 2021, the entire contents of each of which are incorporated herein by reference.

TECHNICAL FIELD

The present patent application relates to a gas/air mixing device of a gas burner and to an assembly having a gas/air mixing device and a fan.

BACKGROUND

EP 1 959 194 B1 and U.S. Pat. No. 9,677,761 B2 both disclose a gas/air mixing device of a gas burner having an integral fan. The gas/air mixing device is configured to mix gas and air to provide a gas/air mixture. The gas/air mixing device has a mixer housing with a mounting flange being configured to mount the gas/air mixing device to a gas burner housing of the gas burner. The mixer housing has an inlet opening for the air, an inlet opening for the gas, and an outlet opening for the gas/air mixture. The mounting flange surrounds the outlet opening for the gas/air mixture.

EP 2 927 584 A1, U.S. Pat. No. 6,106,276 A and EP 3 415 817 A1 also disclose gas/air mixing devices of a gas burner.

EP 2 426 413 A2, EP 2 762 780 A2 and EP 3 015 768 A1 disclose other prior art.

SUMMARY

A novel gas/air mixing device of a gas burner is provided.

The novel gas/air mixing device has a mixer housing with a mounting flange being configured to mount the gas/air mixing device to a fan housing of a fan of the gas burner in such a way that a sealing surface of the mounting flange is in contact with a sealing surface of the fan housing.

The mixer housing of the novel gas/air mixing device has an inlet opening for the air, an inlet opening for the gas, and an outlet opening for the gas/air mixture.

The mounting flange of the mixer housing of the novel gas/air mixing device surrounds the outlet opening of the mixer housing.

According to a first alternative, the sealing surface of the mounting flange of the mixer housing of the novel gas/air mixing device has grooves has being configured to accommodate sealing elements, namely a first groove with a first radius for accommodating a first sealing element, and a second groove with a second radius being different from the first radius for accommodating alternatively a second sealing element.

According to a second alternative, the sealing surface of the fan housing has a groove to accommodate a sealing element, namely either a first groove with a first radius to accommodate a first sealing element or a second groove with a second radius being different from the first radius to accommodate a second sealing element.

The mounting flange of the mixer housing of the novel gas/air mixing device has protrusions with sections being configured to accommodate mounting screws, namely with a first section configured to provide first through holes for mounting screws used when one of the first sealing element and second sealing element shall be used to seal the mixer housing versus the fan housing, and with a second section being configured to provide second through holes for mounting screws used when the other one of the first sealing element and second sealing element shall be used to seal the mixer housing versus the fan housing.

The gas/air mixing device can be used in combination with different fan housings.

The first through holes may be factory-provided. Said first through holes and the first groove are adapted to most common fan housings.

By providing the second through holes and by using a sealing element within the second groove the gas/air mixing device can be used also in combination with other fan housings.

This increases the flexibility of the gas/air mixing device.

According to the above first alternative, the sealing surface of the mounting flange of the mixer housing has at least two grooves both being configured to accommodate respective sealing elements, namely the first groove with the first radius for accommodating the first sealing element, and the second groove with the second radius being different from the first radius for accommodating alternatively the second sealing element. Depending on which of the grooves is used to accommodate the respective sealing element, either the first through holes or the second through holes are used to accommodate the mounting screws.

According to the above second alternative, the sealing surface of the fan housing has the single groove to accommodate the respective sealing element. Depending on the radius of said groove, either the first through holes or the second through holes are used to accommodate the mounting screws.

Preferably, the first through holes provided by the first sections of the protrusions are factory-provided through holes and the second through holes provided by the second sections of the protrusions are field-installed through holes.

According to a preferred embodiment, the first radius of the first groove is larger than the second radius of the second groove. The first sections of the protrusions being configured to provide the first through holes are positioned radially outside of the first groove. The second sections of the protrusions being configured to provide the second through holes are positioned radially outside of the second groove, preferably with radial overlap of the first groove. This increases the flexibility of the gas/air mixing device.

According to a preferred embodiment, the first through holes are oblong holes. Preferably, the oblong holes are arc shaped. This further increases the flexibility of the gas/air mixing device.

The assembly having a gas/air mixing device and a fan is defined in claim 13.

Preferred developments of the invention are provided by the dependent claims and the description which follows.

BRIEF DESCRIPTION OF DRAWINGS

Exemplary embodiments are explained in more detail on the basis of the drawing, in which.

DETAILED DESCRIPTION

Figure 1:
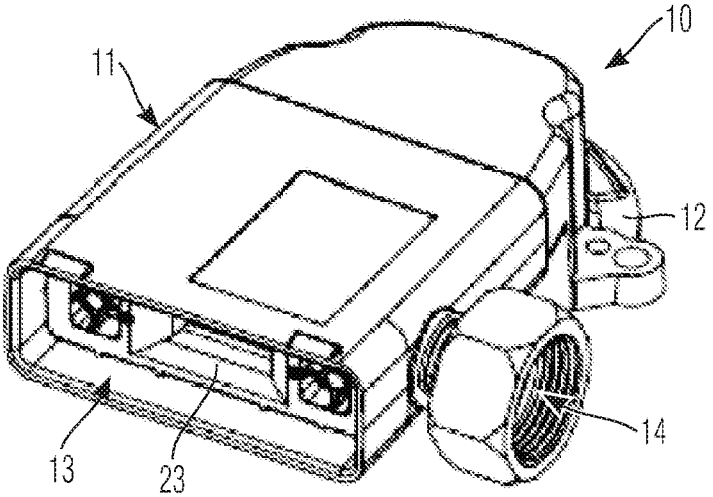
FIG. 1 shows a perspective view of a gas/air mixing device of a gas burner.
Figure 2:
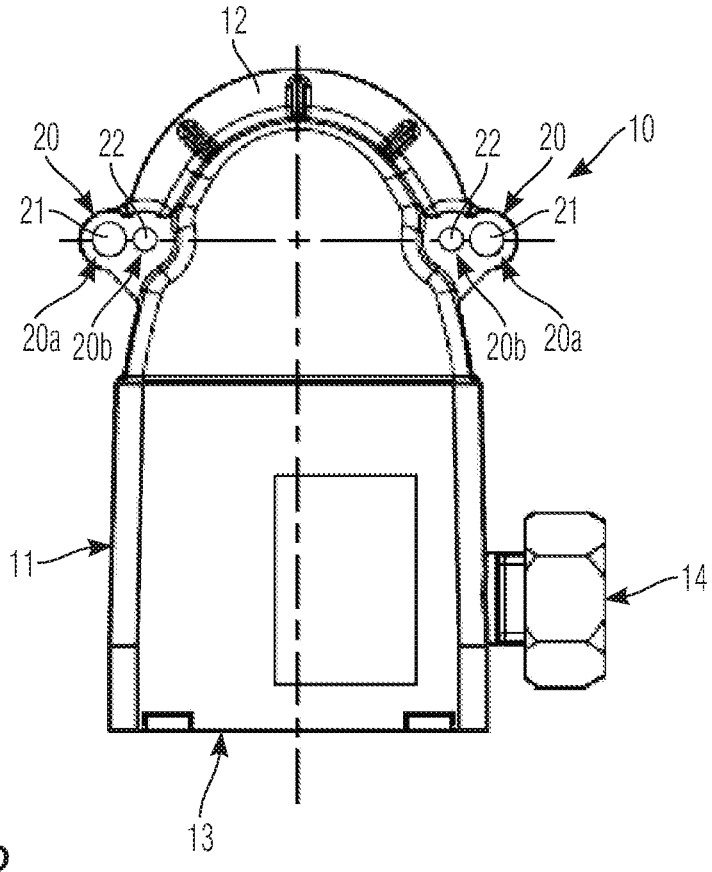
FIG. 2 shows a top view of the gas/air mixing device.

The invention relates to a gas/air mixing device 10 of a gas burner (not shown). The gas/air mixing device 10 has a mixer housing 11 with a mounting flange 12. The mounting flange 12 is configured to mount the gas/air mixing device 10 to a fan housing 25 of a fan 24 of the gas burner.

The mixer housing 11 of the gas/air mixing device 10 has an inlet opening 13 for the air, an inlet opening 14 for the gas, and an outlet opening 15 for the gas/air mixture.

Figure 4:
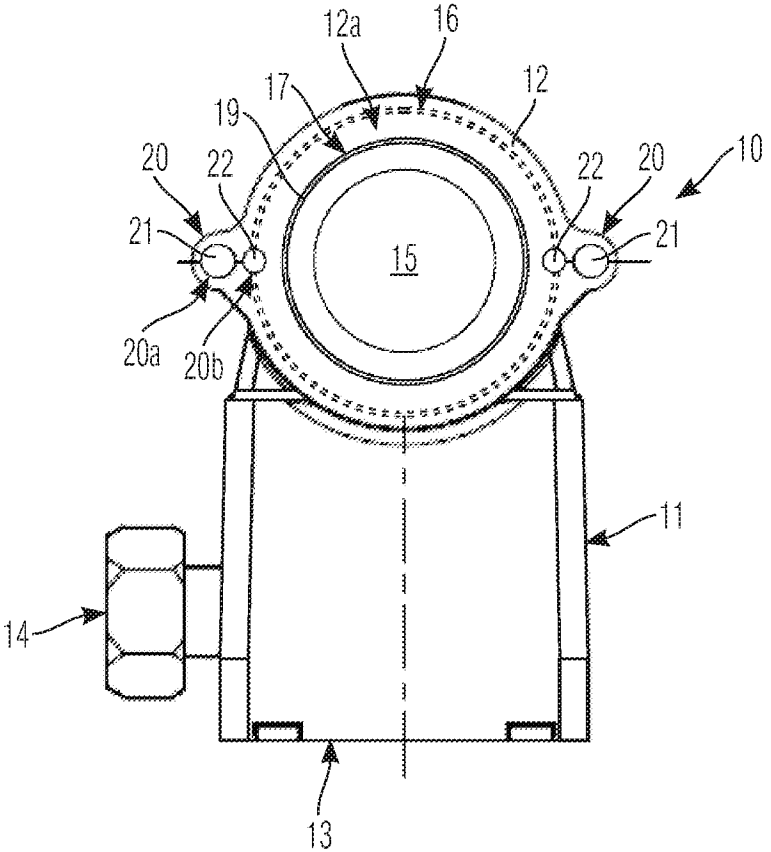
FIG. 4 shows a bottom view of the gas/air mixing device in a second use case of the gas/air mixing device.
Figure 3:
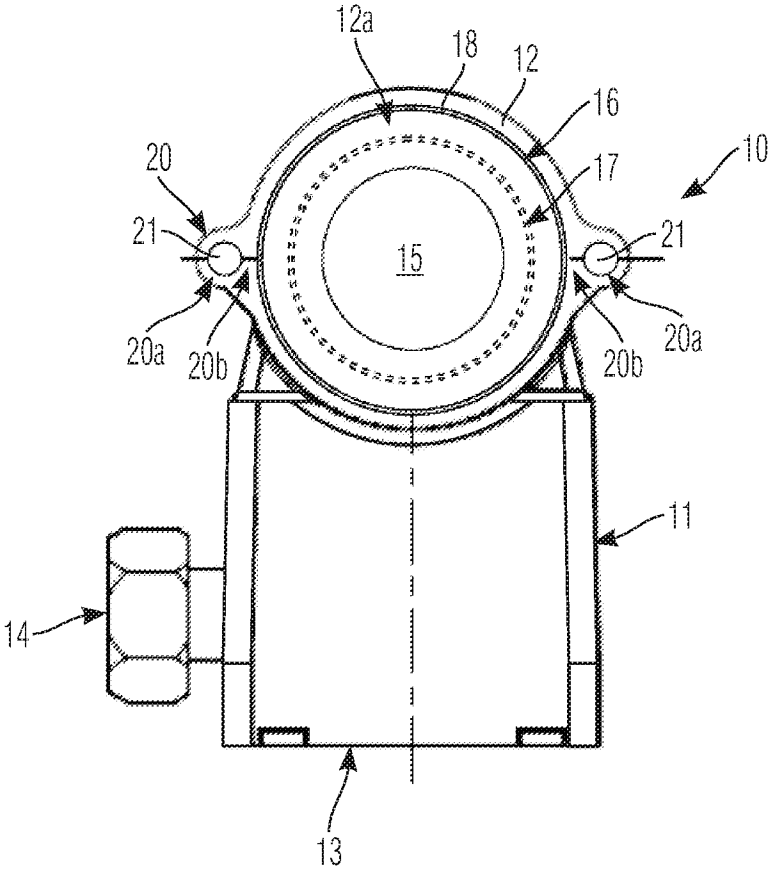
FIG. 3 shows a bottom view of the gas/air mixing device in a first use case of the gas/air mixing device.

The mounting flange 12 of the mixer housing 11 of the gas/air mixing device 10 has a sealing surface 12*a* that surrounds the outlet opening 15 of the mixer housing 11. See FIGS. 3, 4.

When the gas/air mixing device 10 is mounted to the fan 24, the sealing surface 12*a* of the mixer housing 11 is in contact with a sealing surface 26*a* of the fan housing 25 of the fan 24. Said sealing surface 26*a* of the fan housing 25 may be provided by a mounting flange 26 of the fan housing 25.

When the gas/air mixing device 10 is mounted to the fan 24, the outlet opening 15 of the mixer housing 11 is in communication with an inlet opening 27 of the fan housing 25. The fan 24 sucks in the gas/air mixture through the inlet opening 27 of the fan housing 25. The diameter of the outlet opening 15 of the mixer housing 11 is adapted to the diameter of the inlet opening 27 of the fan housing 25. The diameter of the outlet opening 15 of the mixer housing 11 and the diameter of the inlet opening 27 of the fan housing 25 may be identical.

The mixer housing 11 of the gas/air mixing device 10 accommodates a mixing unit 23 to mix the air and the gas.

The mixing unit 23 may be provided by a venturi nozzle.

In the embodiment of FIGS. 1 to 4, the mounting flange 12 of the mixer housing 11 of the gas/air mixing device 10, namely the sealing surface 12*a*, has grooves 16, 17 has being configured to accommodate sealing elements, namely a first groove 16 with a first radius for accommodating a first sealing element 18, and a second groove 17 with a second radius being different from the first radius for accommodating a second sealing element 19.

The sealing elements 18, 19 are preferably provided by sealing rings.

Alternatively (see embodiment of FIGS. 5 to 7), the sealing surface 26*a* of the fan housing 25 has a groove which is configured to accommodate a respective sealing element, namely either the first groove 16 with the first radius for accommodating the first sealing element 18, or alternatively the second groove 17 with the second radius being different from the first radius for accommodating the second sealing element 19.

The mounting flange 12 of the mixer housing 11 of the gas/air mixing device 10 has protrusions 20 with sections 20*a*, 20*b* being configured to accommodate mounting screws 28. Each protrusion 20 has a first section 20*a* being configured to provide first through holes 21 for mounting screws 28 used when one of the first sealing element 18 and second sealing element 19 shall be used to seal the mixer housing 11 versus the fan housing 25. Further on, each protrusion 20 has a second section 20*b* being configured to provide or receive second through holes 22 for mounting screws 28 used when the other one of the first sealing element 18 and second sealing element 19 shall be used to seal the mixer housing 11 versus the fan housing 25.

The first through holes 21 provided by the first sections 20*a* may be factory-provided through holes. The second through holes 22 provided by the second sections 20*b* may be field-installed through holes. In the following description, the first through holes 21 are factory-provided and second through holes 22 may be installed in the field. It may also be possible that both the first and second through holes are all field-installed.

In the embodiment shown in FIGS. 1 to 4, the first radius of the first groove 16 is larger than the second radius of the second groove 17. The first sections 20*a* of the protrusions 20 having the factory-provided first through holes 21 are positioned radially outside of the first groove 16. The second sections 20*b* of the protrusions 20 being configured to provide the field-installed second through holes 21 are positioned radially outside of the second groove 17, in the embodiment shown with radial overlap of the first groove 16.

If there is sufficient space between the first groove 16 and the second groove 17, there may be no radial overlap between the first groove 16 and the field-installed second through holes 21. In this case the second sections 20*b* of the protrusions 20 for providing the field-installed second through holes 21 are positioned radially between the first groove 16 and the second groove 17.

When the first sealing element 18 within the first groove 16 (see FIG. 3) is used to seal the mixer housing 11 versus fan housing 25, then the factory-provided first through holes 21 are used to accommodate mounting screws 28 by which the mixer housing 11 becomes mounted to the fan housing 25. In this case no field-installed second through holes 21 will be drilled into the second sections 20*b* of the protrusions 20. The factory-provided first through holes 21 then fit to respective mounting holes of the fan housing 25.

When the second sealing element 19 within the second groove 17 (see FIG. 4) is used to seal the mixer housing 11 versus fan housing, then field-installed second through holes 21 are be drilled into the second sections 20*b* of the protrusions 20. In this case, the field-installed second through holes 21 are used to accommodate mounting screws 28 by which the mixer housing 11 becomes mounted to the fan housing 25.

In the embodiment shown in FIGS. 1 to 4, the factory-provided first through holes 21 are circular holes.

The gas/air mixing device 10 can be used in combination with different fan housings. This increases the flexibility of the gas/air mixing device 10.

Figure 5:
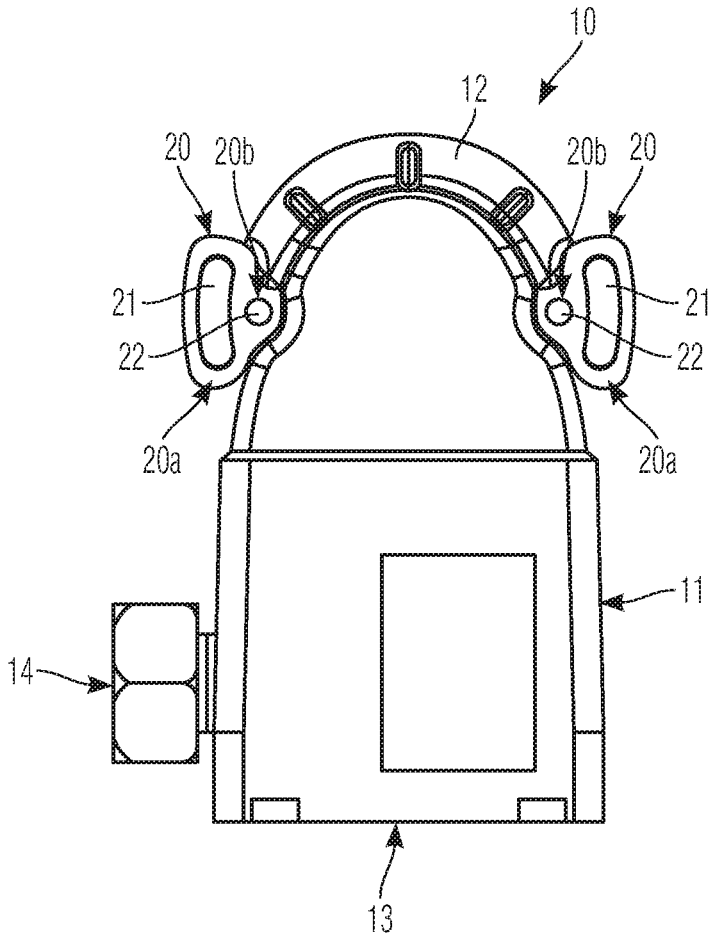
FIG. 5 shows a top view of a further development of gas/air mixing device.
Figure 6:
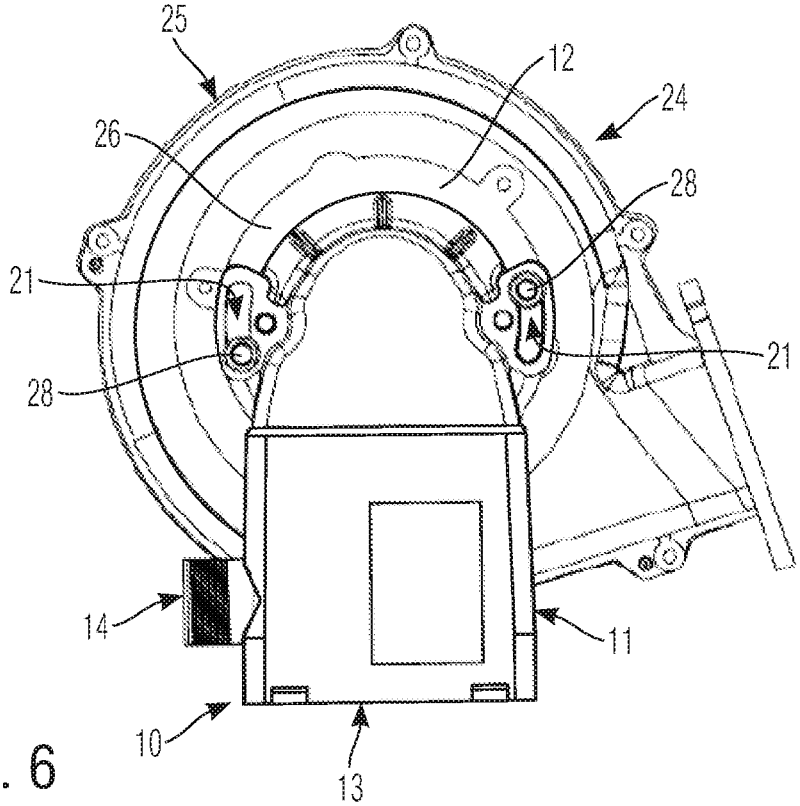
FIG. 6 shows a top view of an assembly having the gas/air mixing device of FIG. 5 and a fan.
Figure 7:
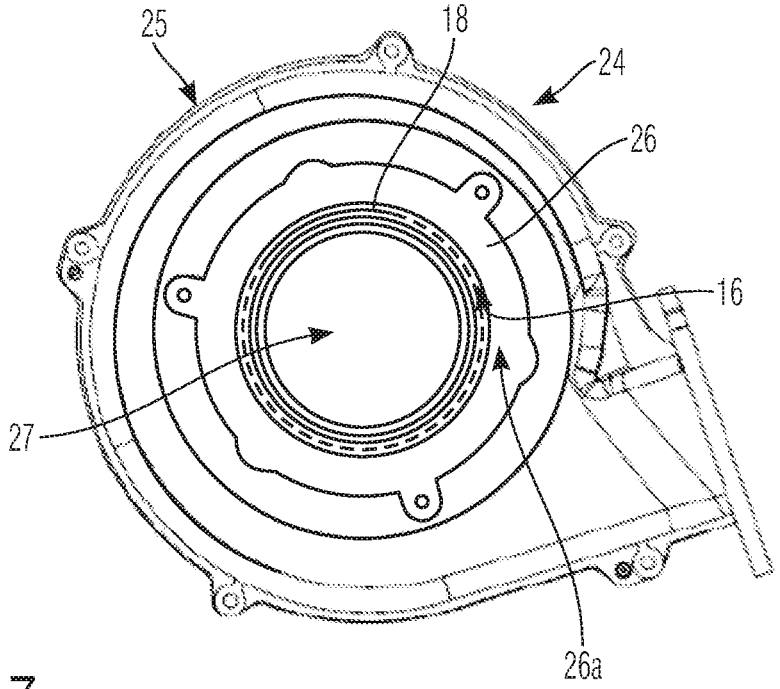
FIG. 7 shows a top view of the fan of FIG. 6.

In the embodiment shown in FIGS. 5 to 7, the factory-provided first through holes 21 are oblong holes, wherein the oblong holes are arc shaped. These oblong holes may be circular arc shaped.

Such oblong holes allow a rotation of the mixer housing 11 versus the fan housing 25 when using the same to mount the mixer housing 11 at the fan housing 25. This further increases the flexibility of the gas/air mixing device 10.

In the embodiment shown in FIGS. 1 to 4, the sealing surface 12*a* of the mounting flange 12 of the mixer housing 11 of the gas/air mixing device 10 has the grooves 16, 17 to accommodate one of the sealing elements 18, 19. So, FIGS. 1 to 4 relate to a gas/air mixing device 10 of a gas burner being configured to mix gas and air to provide a gas/air mixture, wherein the gas/air mixing device 10 has the mixer housing 11 with the mounting flange 12 being configured to mount the gas/air mixing device 10 to the fan housing of the fan of the gas burner in such a way that a sealing surface 12*a* of the mounting flange 12 is in contact with the sealing surface of the fan housing. The sealing surface 12*a* of the mounting flange 12 has the grooves 16, 17 being configured to accommodate the sealing elements 18, 19, namely the first groove 16 with the first radius to accommodate the first sealing element 18, and the second groove 17 with the second radius being different from the first radius to accommodate the second sealing element 19, wherein the first radius of the first groove 16 is larger than the second radius of the second groove 17. The mixer housing 11 provides an inlet opening 13 for the air, an inlet opening 14 for the gas and an outlet opening 15 for the gas/air mixture. The mounting flange 12 of the mixer housing 11, namely the sealing surface 12*a* of the mounting flange 12, surrounds the outlet opening 15 of the mixer housing 11. The mounting flange 12 of the mixer housing 11 has the protrusions 20 with the sections 20*a*, 20*b* being configured to accommodate mounting screws, namely with the first section 20*a* having the first through holes 21—which are preferably factory-provided—for mounting screws used when one of the first sealing element 18 and second sealing element 19 shall be used to seal the mixer housing 11 versus the fan housing, and with the second section 20*b* being configured to provide the second through holes 22—which are preferably field-installed—for mounting screws used when the other one of the first sealing element 18 and second sealing element 19 shall be used to seal the mixer housing 11 versus the fan housing.

The first sections 20*a* of the protrusions 20 having the first through holes 21 are positioned radially outside of the first groove 16. The second sections 20*b* of the protrusions 20 being configured to provide the second through holes 22 are positioned radially outside of the second groove 17.

As mentioned above, alternatively the sealing surface of the fan housing 25 of the fan 24 has a single groove to accommodate a sealing element, namely either a first groove 16 with a first radius to accommodate a first sealing element 18 or a second groove 17 with a second radius being different from the first radius to accommodate a second sealing element 19. This is shown in the embodiment of FIGS. 5 to 7. In the embodiment of FIGS. 5 to 7, the protrusions 20 of the mounting flange 12 of the mixer housing 11 having the sections 20*a*, 20*b* act together with the respective groove of the sealing surface 26*a* of the fan housing 25 as described above.

In the embodiment of FIGS. 5 to 7, depending on the radius of the groove 16, 17 of the sealing surface 26*a* of the fan housing 25 and on the radius of the respective sealing element 18, 19 either the first, preferably factory-provided first through holes 21 or the second, preferably field-installed second through holes 21 are used to accommodate the mounting screws 28 by which the mixer housing 11 becomes mounted to the fan housing 25. In FIG. 6, the first, preferably factory-provided first through holes 21 accommodate the mounting screws 28. The mounting screws 28 accommodated by first through holes 21 penetrate into respective mounting holes (not shown) of the mounting flange 26 of the fan housing 25.

So, FIGS. 5 to 7 relate to an assembly of a gas burner having the fan 24 with the fan housing 25 and the gas/air mixing device 10, the gas/air mixing device 10 being configured to mix gas and air to provide a gas/air mixture.

The gas/air mixing device 10 has the mixer housing 11 with the mounting flange 12 being mounted to the fan housing 25 of the fan 24 in such a way that a sealing surface 12*a* of the mounting flange 12 is in contact with a sealing surface of the fan housing.

The sealing surface of the fan housing 25 has a single groove to accommodate a sealing element 18, 19, namely either the groove 16 with a first radius to accommodate a first sealing element 18 or the groove 17 with a second radius being different from the first radius to accommodate a second sealing element 19, wherein the first radius of the groove 16 is larger than the second radius of the groove 17.

The mixer housing 11 provides an inlet opening 13 for the air, an inlet opening 14 for the gas and an outlet opening 15 for the gas/air mixture. The mounting flange 12 of the mixer housing 11, namely the sealing surface 12*a* of the mounting flange 12, surrounds the outlet opening (15) of the mixer housing 11.

The mounting flange 12 of the mixer housing 11 has the protrusions 20 with the sections 20*a*, 20*b* being configured to accommodate mounting screws, namely with the first sections 20*a* having the first through holes 21—which are preferably factory-provided—for mounting screws, and with the second sections 20*b* being configured to provide the second through holes 22—which are preferably field-installed—for mounting screws. Depending on the radius of the groove 16, 17 of the sealing surface 26*a* of the fan housing 25 and on the radius of the respective sealing element 18, 19 either the first through holes 21 or the second through holes 21 are used to accommodate the mounting screws by which the mixer housing 11 becomes mounted to the fan housing 25.

LIST OF REFERENCE SIGNS

10 gas/air mixing device
11 housing
12 mounting flange
12*a* sealing surface
13 air inlet opening
14 gas inlet opening
15 gas/air outlet opening
16 groove
17 groove
18 sealing element
19 sealing element
20 protrusion
20*a* section
20*b* section
21 through holes
22 through holes
23 mixing unit
24 fan
25 fan housing
26 mounting flange
26*a* sealing surface
27 inlet opening
28 mounting screw

What is claimed is:

1. A gas/air mixing device of a gas burner, the gas/air mixing device being configured to mix gas and air to provide a gas/air mixture, wherein the gas/air mixing device includes:

a mixer housing including a mounting flange configured to mount the gas/air mixing device to a fan housing of a fan of the gas burner in such a way that a sealing surface of the mounting flange is in contact with a sealing surface of the fan housing, wherein the sealing surface of the mounting flange has grooves being configured to accommodate sealing elements, namely a first groove with a first radius to accommodate a first sealing element, and a second groove with a second radius being different from the first radius to accommodate a second sealing element, or wherein the sealing surface of the fan housing has a groove to accommodate a sealing element, the groove comprising at least one of a first groove with a first radius to accommodate a first sealing element or a second groove with a second radius being different from the first radius to accommodate a second sealing element, the mixer housing provides an inlet opening for the air, the mixer housing provides an inlet opening for the gas, the mixer housing provides an outlet opening for the gas/air mixture, the mounting flange of the mixer housing, namely the sealing surface of the mounting flange, surrounds the outlet opening of the mixer housing, and the mounting flange of the mixer housing has protrusions with sections being configured to accommodate mounting screws, the sections comprising:

a first section being configured to provide first through holes for mounting screws used when one of the first sealing element and second sealing element shall be used to seal the mixer housing versus the fan housing, and a second section being configured to provide second through holes for mounting screws used when the other one of the first sealing element and second sealing element shall be used to seal the mixer housing versus the fan housing.

2. The gas/air mixing device of claim 1, wherein the first sections have factory-provided through holes.

3. An assembly comprising:

the gas/air mixing device of claim 2; and a fan.

4. The gas/air mixing device of claim 1, wherein the second through holes provided by the second sections are field-installed through holes.

5. An assembly comprising:

the gas/air mixing device of claim 4; and a fan.

6. The gas/air mixing device of claim 1, wherein:

the first radius of the first groove is larger than the second radius of the second groove, the first sections of the protrusions having the first through holes are positioned radially outside of the first groove, the second sections of the protrusions being configured to provide the second through holes are positioned radially outside of the second groove.

7. The gas/air mixing device of claim 6, wherein the second sections of the protrusions are positioned with radial overlap to the first groove.

8. An assembly comprising:

the gas/air mixing device of claim 7; and a fan.

9. The gas/air mixing device of claim 6, wherein the second sections of the protrusions are positioned radially between the first groove and the second groove.

10. An assembly comprising:

the gas/air mixing device of claim 9; and a fan.

11. The gas/air mixing device of claim 6, wherein the first through holes of the first sections are configured to accommodate the mounting screws when the first sealing element is used to seal the mixer housing versus the fan housing.

12. The gas/air mixing device of claim 6, wherein the second through holes provided at the second sections are configured to accommodate the mounting screws when the second sealing element is used to seal the mixer housing versus the fan housing.

13. An assembly comprising:

the gas/air mixing device of claim 6; and a fan.

14. The gas/air mixing device of claim 1, wherein the first through holes are circular holes.

15. The gas/air mixing device of claim 1, wherein the first through holes are oblong holes.

16. The gas/air mixing device of claim 15, wherein the oblong holes are arc shaped.

17. The gas/air mixing device of claim 15, wherein the oblong holes are circular arc shaped.

18. An assembly comprising:

the gas/air mixing device of claim 1; and a fan.

* * * * *